United States Patent [19]

Yoneda

[11] Patent Number: 4,576,583

[45] Date of Patent: Mar. 18, 1986

[54] TOY CAPABLE OF EXECUTING MULTIPLE MOVING MODES

[75] Inventor: Yosuke Yoneda, Tokyo, Japan

[73] Assignee: Tomy Kogyo Co., Inc., Tokyo, Japan

[21] Appl. No.: 654,167

[22] Filed: Sep. 24, 1984

[30] Foreign Application Priority Data

Sep. 29, 1983 [JP] Japan ..... 58-150771

[51] Int. Cl.[4] ..... A63H 17/00

[52] U.S. Cl. ..... 446/94; 446/277; 446/448; 446/457; 446/471

[58] Field of Search ..... 446/285, 292, 293, 294, 446/279, 280, 93, 94, 95, 102, 103, 437, 448, 457, 465, 467, 469, 470, 471, 330, 354, 355, 356

[56] References Cited

U.S. PATENT DOCUMENTS

| | | | |
|---|---|---|---|
| 122,707 | 1/1872 | Clay | 446/292 |
| 2,600,984 | 6/1952 | Fields | 446/294 |
| 3,050,900 | 8/1969 | Glass et al. | 446/293 |
| 3,529,479 | 9/1970 | Ryan et al. | 74/15.4 |
| 3,555,722 | 1/1971 | McLain et al. | 446/293 |
| 4,109,398 | 8/1978 | Hida | 446/94 |
| 4,248,006 | 2/1981 | Jones et al. | 446/94 |
| 4,307,533 | 12/1981 | Sims et al. | 446/94 |
| 4,459,776 | 7/1984 | Jaworski et al. | 446/457 |

*Primary Examiner*—Robert A. Hafer
*Assistant Examiner*—Daniel Nolan
*Attorney, Agent, or Firm*—K. H. Boswell

[57] ABSTRACT

A moving toy has a plurality of rotating elements located along opposite sides of its body. A motor is connected to these elements via a gear train so as to rotate the elements on the body. A plurality of sets of movable members each are capable of independently being connected to either the rotating elements or to both the rotating elements and the body. Each of the sets of the movable members when connected to the rotating elements are capable of moving the body in a unique manner which differs from the method of movement of any of the other of the sets of the members. The members can include eccentric rolling members, single walking members or compound walking members.

11 Claims, 8 Drawing Figures

TOY CAPABLE OF EXECUTING MULTIPLE MOVING MODES

BACKGROUND OF THE INVENTION

This invention is directed to a toy which is capable of moving utilizing a variety of members which can be detachably connected to the body of the toy. The members are moved with respect to the body of the toy in unique manners by a motor which transmits its output to the members via rotating elements.

Rolling toys are known which have eccentrically mounted wheels such that as the toy rolls across a support surface the toy moves in a very novel up and down motion in combination with its forward motion. Other toys are known which utilize two or more leg-like appendages which are capable of moving in a walking or semi-walking manner to propel the toy across a support surface. Generally, the first type of toy which utilizes eccentric wheels are comic vehicle type toys, and the second type are designed to mimic animals and the like. These toys are highly entertaining to children playing with the same because of their comical or unique moving motions.

Of the toys described above, however, the toy is limited to moving in either one mode of locomotion or another because the eccentric wheels, appendages or other moving members are fixed to the toy and are not interchangeable with one another. This is understandable because normally toys which utilize eccentrically mounted wheels have the axle directly connected to the wheel and toys which move utilizing appendages and the like are generally driven by cranks or cams.

BRIEF DESCRIPTION OF THE INVENTION

In view of the above, it is considered that if a toy was capable of executing many different types of motion such as motion based on eccentrically rotating wheels or motion based on walking members, then this toy would be capable of providing a child using the same many hours of entertainment and would further provide a learning environment for the child. In view of this, it is a broad object of this invention to provide such a toy. It is a further object of this invention to provide a toy which is capable of moving in a variety of modes which differ from one another. It is an additional object of this invention to provide a toy which has a plurality of moving members which are interchangeable on the body of the toy in an easy and simple manner, yet when any particular moving member is attached to the toy, the toy is capable of functioning in a unique manner. It is a further object of this invention to provide a toy which, because of the engineering principles incorporated therein, is capable of providing enjoyment to a child yet is not unduly complex, and as such is capable of being presented to the consumer at an economical price.

Other objects, as will become evident from the remainder of this specification are achieved in claim 1.

The moving means preferredly includes at least two sets of moving members each of which is independently detachably connectable to the rotating elements. Further, preferredly, a plurality of the rotating elements would be located on the body so as to allow a variety of moving members to be attached thererto. In the illustrative embodiment, the use of three sets of rotating elements allows the attachment of a moving means having two moving members four moving members and six moving members to be attached to the body of the toy. Further, an embodiment of the invention is shown wherein a detachable member can be connected to the toy and the toy moved directly by contacting two of the rotating elements against a support surface.

The moving members can be chosen such that certain of them rotate with respect to the body of the toy and preferredly eccentrically rotate with respect to the body, and other of the moving members move in a walking-like manner with respect to the body of the toy. For those moving members which propel the toy in a walking-like manner, the members can be further preferredly subdivided such that only two of the members are necessary to move the toy or a multiplicity of members can be used which move in a coordinated manner with respect to one another.

BRIEF DESCRIPTION OF THE DRAWINGS

This invention will be better understood when taken in conjunction with the drawings wherein.

Figure 1:
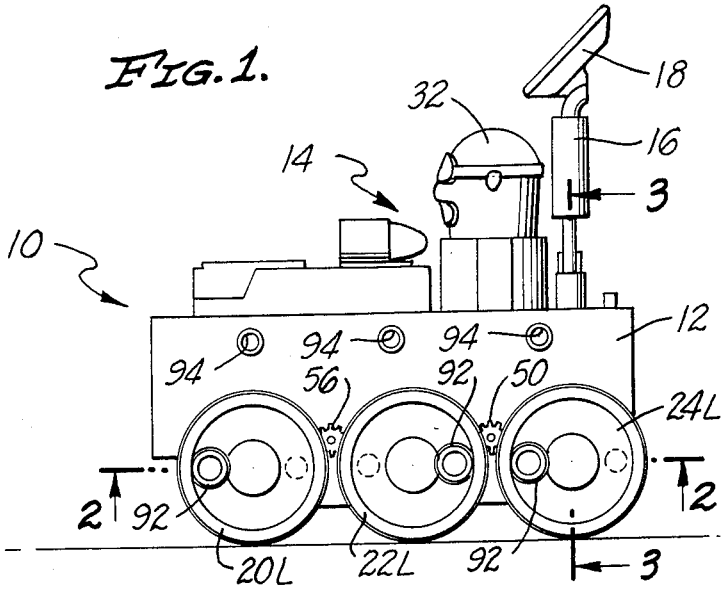
FIG. 1 is a side elevational view of the basic component of the toy of this invention.

This invention utilizes certain principles and/or concepts as are set forth in the claims appended to this specification. Those skilled in the toy arts will realize that these principles and/or concepts are capable of being expressed in a varity of embodiments which might differ from the precise illustrative embodiments described in this specification and shown in the drawings. For this reason this invention is not to be construed as being limited to only the illustrative embodiment, but is only to be construed in view of the claims.

DETAILED DESCRIPTION OF THE INVENTION

In FIG. 1 there is shown the basic module 10 of a toy. The module 10 includes a body 12 having certain superstructure items, collectively identified by the numeral 14. On the rear of the body 12 is a movable tail pipe 16 and a rotating antenna 18.

The body 12 further includes a front set of wheels, wheels 20L and 20R, a middle set of wheels, wheels 22L and 22R, and a rear set of wheels, wheels 24L and 24R. Each of the wheels 20, 22 and 24 serve as a rotating element which, as seen in FIG. 1, can drive the module 10 directly on a support surface or as seen in certain other of the Figures, can be used to drive other components, as hereinafter identified, which in turn move the module 10 over a support surface.

Figure 2:
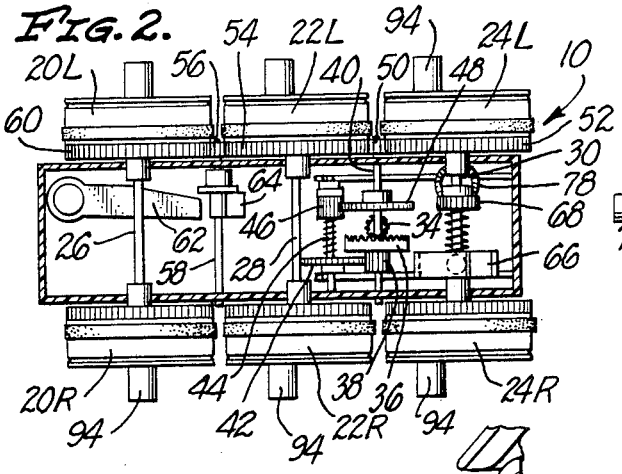
FIG. 2 is a bottom plan view in partial section about the line 2—2 of FIG. 1.
Figure 3:
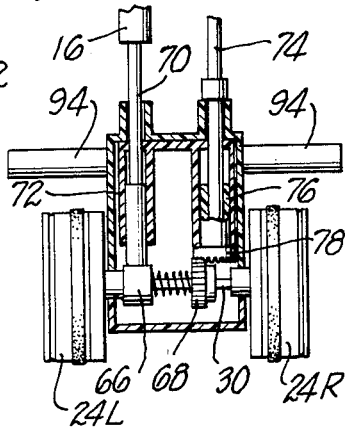
FIG. 3 is a fragmentary rear elevational view in partial section about the line 3—3 of FIG. 1.

Looking now at the interior of the module 10 in FIGS. 2 and 3, the front wheels 20 are fixedly mounted to a front axle 26, the middle wheels 22 are fixed to a middle axle 28 and the rear wheels 24 are fixed to a rear axle 30. As such, rotation of one of the wheels 20 will rotate the other of the wheels 20 via the front axle 26, rotation of the one of the wheels 22 will rotate the other of the wheels 22 through the middle axle 28 and rotation of one of the rear wheels 24 will rotate the other of the wheels 24 through the rear axle 30. Each of the axles 26, 28 and 30 are appropriately suspended in bearing surfaces formed in the body 12 such that the axles and the wheels attached thereto are free to rotate with respect to the body 12.

A small electrical motor, not numbered or shown, is horizontally oriented in the body 12 within the figurine portion 32 of the superstructure 14 located on the body 12. This motor is appropriately supplied with electrical power via dry cells, also not separately shown or numbered within the front portion of the body 12. In any event, the output from the motor turns a small pinion 34 which is attached to the motor drive shaft. The pinion 34 meshes with a crown gear 36 which is formed as an integral unit with a pinion 38. Both the crown gear 36 and the pinion 38 are free wheeling about a shaft 40 such that they rotate independent of the shaft 40. A spur gear 42 which is fixed to a shaft 44 meshes with the pinion 38 such that rotation of the motor pinion 34 ultimately rotates the shaft 44. The shaft 44 also carries a pinion 46 fixed to it such that it rotates in response to rotation of the shaft 44. A spur gear 48 fixed to the shaft 40 meshes with the pinion 46 such that ultimately rotation transferred to the spur gear 48 rotates the shaft 40.

The shaft 40 is appropriately suspended in bearing holes located in the body 12 with one end of the shaft 40 extending out of the body 12 and carrying a pinion 50 fixedly located thereon. The pinion 50 meshes with a gear 52 integrally formed as a portion of wheels 24R as well as with a gear 54 integrally formed as a portion of wheel 22R. A further pinion 56 also meshes with the gear 54. The pinion 56 is fixed to a shaft 58 which is appropriately suspended in bearing holes formed on the body 12 with the pinion 56 also meshing with a gear 60 which is integrally formed with the wheel 20R. Because of this, rotation of the shaft 40 ultimately rotates all of the wheels 24R, 22R and 20R with rotation of these wheels transferred by axles 30, 28 and 26 to wheels 24L, 22L and 20L. Thus, all of the wheels, 20, 22 and 24 rotate in the same direction ultimately in response to rotation of the output pinion 34 of the motor.

A small spring 62 fixed at one of its ends to the inside of the body 12 is positioned such that its other end interacts with a cam 64 which is fixed to the shaft 58. Rotation of the shaft 58 causes the cam 64 to ultimately contact the end of the spring 62 and releases the same such that a clicking noise is produced.

Within the interior of the body 12 fixed to the rear axle 30 is a cam 66. Also fixed to the rear axle 30 is a small pinion 68. The tail pipe 16 is attached to a shaft 70 which rides within a boss 72 such that the end of the shaft 70 rests against the cam 66. As the rear axle 30 rotates the cam 66 raises and then lowers the shaft 70 within the boss 72 such that the tail pipe 16 moves up and down.

The antenna 18 is attached to a shaft 74 which is free to rotate within a boss 76. Located on the lower end of the shaft 74 is a crown gear 78 which meshes with the pinion 68. Rotation of the rear axle 30 is therefore transferred via the pinion 68 to the crown gear 78 which in turn rotates the shaft 74 to rotate the antenna 18.

Figure 4:
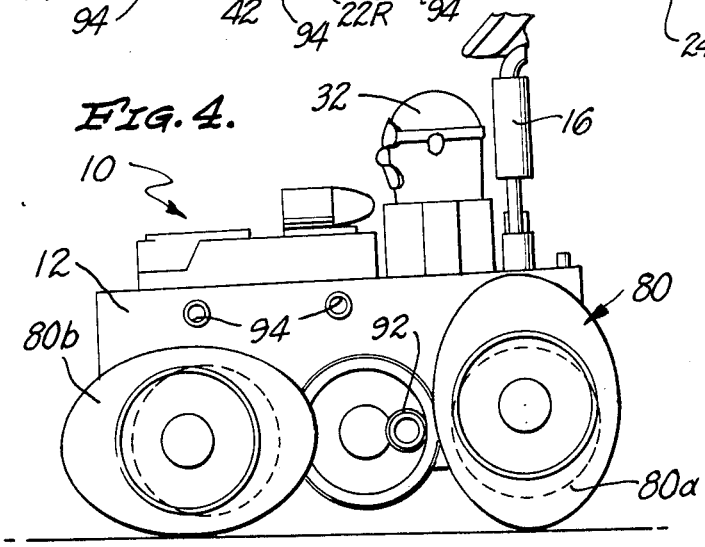
FIG. 4 is a view similar to FIG. 1 except that a first set of moving elements have been attached to the basic structure of FIG. 1.
Figure 5:
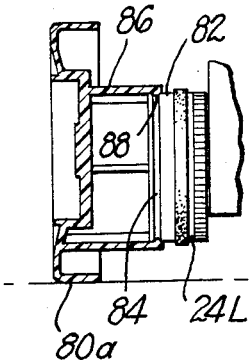
FIG. 5 is an elevational view in partial section showing attachment of the moving element of FIG. 4 to a portion of the basic structure of FIG. 1.

In FIG. 4, four eccentric wheels, collectively identified by the numeral 80, have been attached to the basic module 10. The wheels 80 are not only eccentric with respect to having their center not located axially with the center of the wheel to which they attach, but they are also eliptical, or egg shaped. An outer rim surface 82 on each of the wheels 20, 22 or 24 includes a groove 84 which can be considered as a connecting means on the wheels. Each of the eccentric wheels 80 includes a skirt 86 having an interior circumferentially extending flange 88 which will fit into the groove 84 to hold the eccentric wheel 80 to one of the other wheels 20, 22 or 24. Thus, as seen in FIG. 5, the eccentric wheel **80*a* is attached to the wheel 24R by coupling of the flange 88 within the skirt 86. This frictionally holds the eccentric wheel 80 to the wheel 24R**.

As seen in FIG. 4, the wheel **80*b* has its major eliptical axis oriented with the minor eliptical axis of wheel 80*a*, whereby, upon rolling of the wheels 80*a* and 80*b*, the basic module 10 is caused to oscillate in a rocking-like motion as it travels over a support surface. It is evident that the child utilizing the toy of the invention could orient the eccentric wheels 80 in any one of a number of orientations with respect to one another, both fore and aft with respect to the basic module as well as right and left of the basic module. Because of this, a series of novel movements can be produced utilizing the embodiment of the toy as seen in FIG. 4**.

Figure 6:
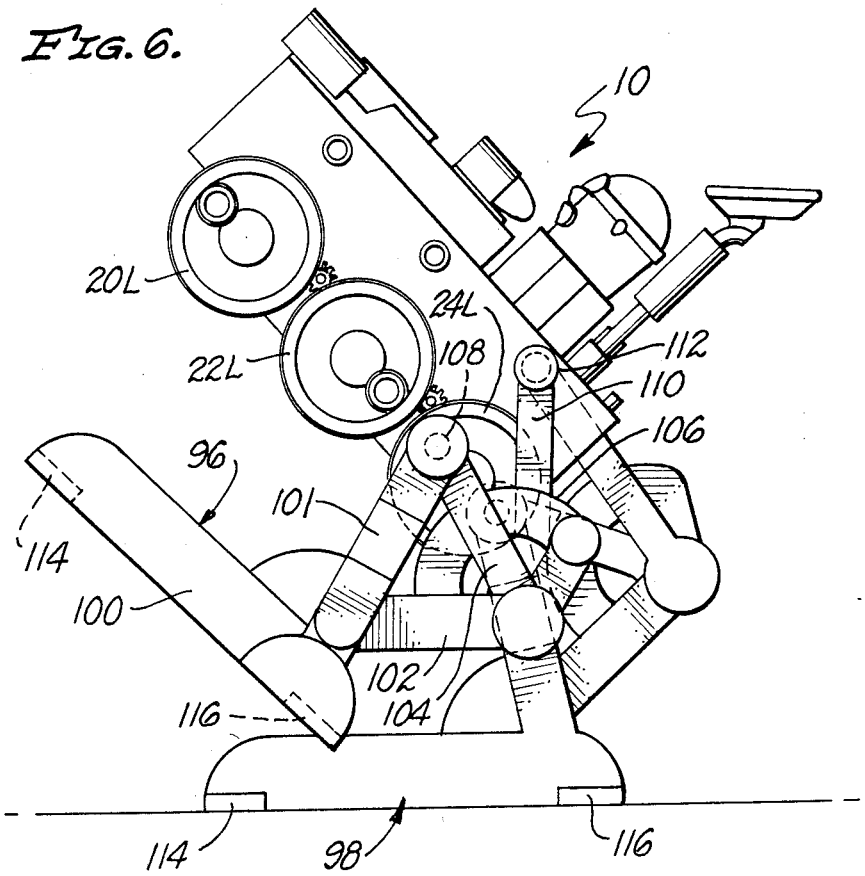
FIG. 6 is a view similar to FIG. 1 except a second set of moving elements have been attached to the basic structure of FIG. 1.

In FIG. 6 a further embodiment is shown. Prior to discussing this embodiment, however, as is evident from FIGS. 1 or 6, each of the wheels 20, 22 or 24 includes a circular hollow boss, collectively identified by the numeral 92. The hollow bosses 92 on the wheels 20, 22 or 24 serves as a further connecting means on these wheels or rotating elements. Located above each one of the wheels 20, 22 and 24 on both the right and left hand sides of the body 12 are solid bosses collectively identified by the numeral 94. As is evident from looking at FIG. 2, the solid bosses 94 extend outwardly from the respective sides of the body 12 a certain extent beyond the outer surfaces of any of the wheels 20, 22 or 24.

A left sided, two legged walking member 96 and a right sided two legged walking member 98 are connectable to any one of the wheels 20, 22 and 24R and L respectively, but preferredly to the rear wheels 24L and 24R. Each of the walking members 96 and 98 includes equivalent structure elements, but they are formed as mirror images of one another, so that one serves as a walking member for the left side and one serves as a walking member for the right side. Insofar as the members 96 and 98 are identical except for their mirror imagery, like components will be numbered with like numbers of these members.

The member 96 includes a base member 100 which is integrally formed as a single component with three triangular struts 101, 102 and 104. Further, an arcuate strut 106 is also integrally formed with these members. The totality of this structure moves as a unit. At the intersection of struts 100 and 104 is a pin 108 which is sized and shaped to fit within the interior of the hollow boss 92 on the wheel, as for instance, wheel 24L. The hollow bosses 92 are not integrally formed as a part of wheels 20, 22 or 24, but are free to rotate on these wheels. As such, when the pin 108 of the member 96 is inserted into the boss 92, this allows the member 96 to rotate with respect to the wheel, as for instance, wheel 24L.

Pivotally attaching to the intersection between the struts 102 and 104 on the member 96 is a further strut 110. Strut 110 includes a hollow boss 112 on its end which fits over the solid boss 94 on the body 12. This fit is a loose fit allowing the boss 112 to rotate about the boss 94 while still maintaining the strut 110 pivotally attached to the body 12. The strut 110 as such can pivot about the boss 94 on the body 12 and also about its connection with the member 96.

As the wheel 24R rotates, because the strut 110 is essentially connected to the body 12, rotation of the wheel 24L causes the member 96 to move between a position as seen in FIG. 6 to a position wherein it would be located as per the member 98 in FIG. 6. This essentially yields a walking-like movement for the member 96 and, taken in conjunction with identical movement for the member 98, propels the basic module 10 in a walking-like manner across a support surface. Two cross members 114 and 116 located on the front and rear ends of the strut 100 of the member 96 form a platform-like surface to provide stability for the basic module 10 when it is supported by one or the other of the members 96 or 98.

Figure 7:
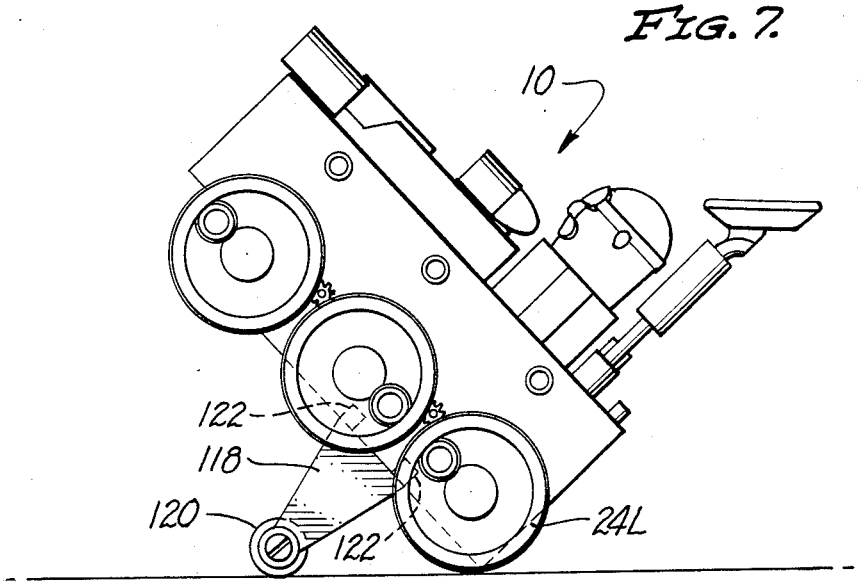
FIG. 7 is a view similar to FIG. 1 except a third set of movable elements have been attached to the basic structure of FIG. 1.

Looking now at FIG. 7, a member 118 having a wheel 120 rotatably mounted at one of its ends includes two projections, collectively identified by the numeral 122, which fit into appropriate openings, not separately numbered or shown, in the bottom of the body 12 so as to frictionally connect the member 18 to the bottom of the body 12. This allows positioning of the basic module 10 in the position seen in FIG. 7 with the module 10 supported by the wheel 120 and the wheels 24L and 24R. As such, the basic module 10 is propelled by the wheels 24L and 24R at an angle across a support surface.

Figure 8:
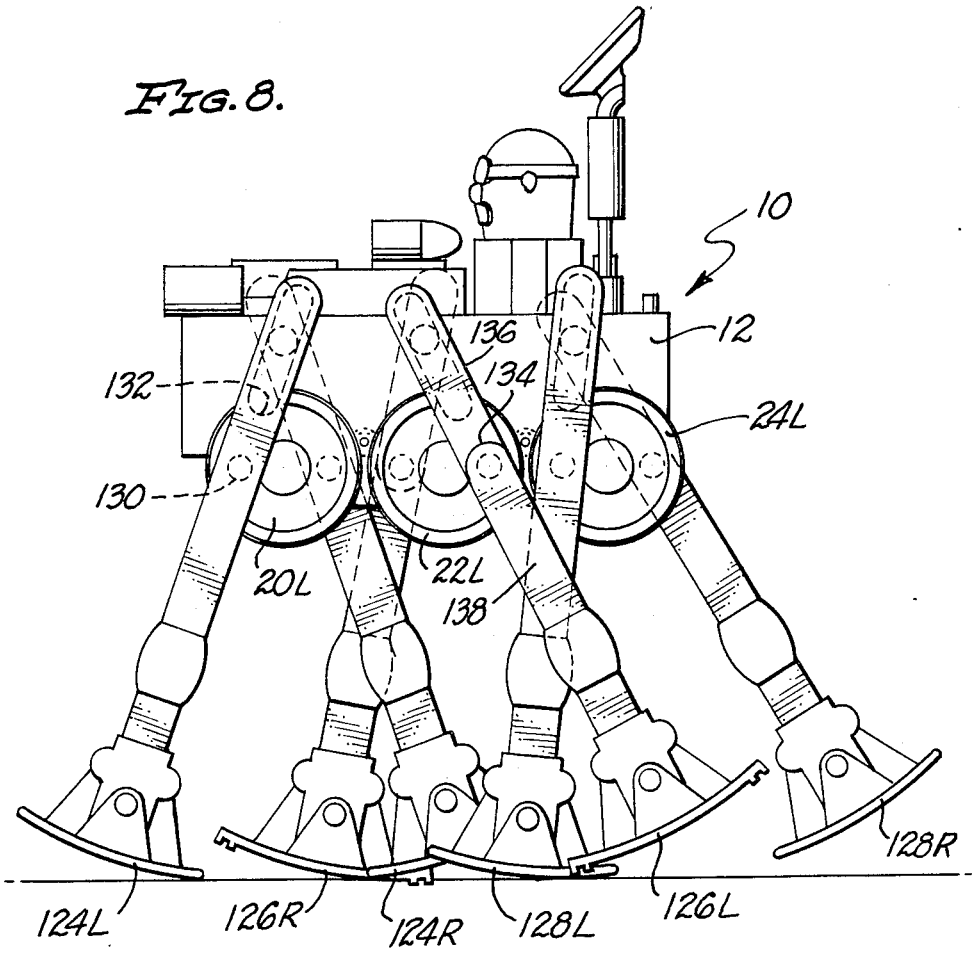
FIG. 8 is a view similar to FIG. 1 except a fourth set of moving elements have been attached to the basic structure of FIG. 1.

FIG. 8 shows a further embodiment. In this embodiment, the basic module 10 is supported above a support surface by six legs, which will be identified in groups as were the wheels 20, 22 and 24. Front legs 124L and R, are associated with the front wheels 20L and R. Middle legs 126L and R are associated with the middle wheels 22L and R. Finally, rear legs 128L and R are associated with the rear wheels 24L and R. Since each of the legs 126, 126 or 128 connects to its respective wheels 20, 22 and 24 in the same manner, the connection of only one of these will be described.

The leg 124L includes a pin 130 which fits into the hollow boss 92 on the wheel 20L. The leg 124L further includes an elongated slot 132 located on the inside of its upper end. The slot 132 fits over the boss 94 associated with the wheel 20L. As the wheel 20L rotates, its movement is transferred to the leg 124L, causing the slot 132 to slide over the pin 94. This attachment moves the bottom end of the leg 124 first backwardly as seen in FIG. 8, then upwardly, then forwardly, then downward to the same position seen in FIG. 8 such that it moves in a walking-like manner. The remainder of the legs 126 and 128 attached to the respective wheels 22 and 24 in the same manner.

The middle legs 126L and R contain a dog-leg 134 at the position wherein their pins 130 attach. As such, the upper portion of the middle legs 136 is in a first plane and the lower portion 138 is in a second plane which is outwardly displaced from the first plane. Since the plane 136 is in the same fore and aft vertical plane as are the legs 124 and 128, by moving the lower plane 138 outwardly it allows the middle leg 126 to swing across both the forward and rear legs 124 and 128 respectively, without contacting them. This is evident in FIG. 8 wherein leg 126L crosses legs 128L by having its lower portion 138 positioned outwardly from the leg 128L.

As is evident in FIG. 1, the hollow boss 92 on the front wheel 20L and the rear wheel 24L are both positioned at about the nine o'clock position. The hollow boss 92 on the middle wheel 22L is positioned 180° out of phase, at about the three o'clock position. Because of this, for the embodiment of FIG. 8, the front leg 124 moves in synch with the rear leg 128, with the middle leg 126 180° out of sync. Further, the wheels on the left side of the body 12 of the basic module 10 are 180° out of sync with regard to wheel on the right side of the body 12. Thus, also as is evident in FIG. 8, when the left front leg 124L is forward, the right front leg 124R is backward. Thus, the middle leg on one side of the body moves in sync with the front and rear legs on the opposite side of the body and vice versa. This always maintains the basic module 10 when it is in the configuration of FIG. 8 supported on a triangular type support, utilizing three legs.

It is evident that utilizing the basic rotating elements, the wheels 20, 22 and 24, that a plurality of moving members or moving means, i.e., the eccentric wheels 80, the walking members 96 and 98 or the legs 124, 126 and 128, can be utilized in conjunction with the rotating elements. Further, other moving members could also be attached to the wheels 20, 22 and 24 in equivalent manners as was described for the illustrative embodiment. It is evident also that, as for instance, with the eccentric wheels 80, they could be placed only on one or the other of the front wheels 20 or 24, with the other of the front or rear wheels 20 or 24 simply serving as a regular wheel as per the embodiment of FIG. 7.

I claim:

1. A moving toy which comprises:

a unitary body;

motor means mounted on said body;

at least two rotating elements permanently rotatively mounted on said body, each of said rotating elements operatively connected to said motor means so as to be rotated on said body by said motor means;

at least two sets of moving members, each of said sets of moving members independently temporarily connectable to said rotating elements, and when said moving members are connected to said rotating elements said moving member supporting said toy on a support surface, each of said sets of moving members differing from the other of said sets of moving members whereby one of said sets of moving members moves said toy on said support surface in a rolling manner and a further of said sets of moving members moves said toy on said support surface in a walking manner.

2. The toy of claim 1 including:

at least four of said rotating elements, said rotating elements located on said body in sets of two elements each, each of said rotating elements operatively connected to said motor means so as to rotated by said motor means.

3. The toy of claim 2 wherein:

one of said sets of moving members is detachably connectable to at least two of said sets of rotating elements.

4. The toy of claim 3 wherein:

a further of said sets of moving members is detachably connectable to only one of said sets of rotating elements.

5. The toy of claim 1 wherein:

said rolling manner is eccentric rotation.

6. The toy of claim 1 including:

a first set of connecting means located on said rotating elements, a second set of connecting means for movably connecting said moving members to said rotating elements and said body respectively, said moving members temporarily connectable to at least said first set of said first and said second sets of connecting means.

7. The toy of claim 6 wherein:

each of said sets of moving members independently temporarily connectable to said connecting means on said rotating elements, one of said sets of moving members further temporarily connectable to said connecting means on said body.

8. The toy of claim 1 including:

at least three of said sets of members.

9. The toy of claim 8 including:

one of said sets of members having two members, a further of said sets having four members and even further of said sets having six members.

10. The toy of claim 8 including:

six of said rotating elements arranged in a group of three on a first side of said body and a group of three on a second side of said body.

11. The toy of claim 1 including:

six of said rotating elements arranged in a group of three on a first side of said body and a group of three on a second side of said body.

* * * * *

UNITED STATES PATENT AND TRADEMARK OFFICE

CERTIFICATE OF CORRECTION

PATENT NO. : 4,576,583

DATED : MARCH 18,1986

INVENTOR(S) : YOSUKE YONEDA

It is certified that error appears in the above-identified patent and that said Letters Patent is hereby corrected as shown below:

Column 1, line 65, "thererto" should be --thereto--.
Column 3, line 40, "wheels" should be --wheel--.
Column 4, line 63, "100" should be --101--.
Column 5, line 23, "100" should be --101--.
Column 5, line 47, the first occurrence of the numeral "126" should be --124--.
Column 6, line 63, after the word "to" add the word --be--.

Signed and Sealed this

Fourth Day of November, 1986

[SEAL]

*Attest:*

DONALD J. QUIGG

*Attesting Officer*

*Commissioner of Patents and Trademarks*